US005127574A

United States Patent [19]

Mosser et al.

[11] Patent Number: 5,127,574

[45] Date of Patent: Jul. 7, 1992

[54] SPRAY BOOTH FOR APPLYING COATINGS TO A SUBSTRATE AND CONTROL DEVICE THEREFORE

[75] Inventors: Mark F. Mosser, Sellersville; Bruce G. McMordie, Perkasie, both of Pa.

[73] Assignee: Sermatech International Inc., Limerick, Pa.

[21] Appl. No.: 516,674

[22] Filed: Apr. 30, 1990

[51] Int. Cl.[5] ..... B05B 7/00

[52] U.S. Cl. ..... 236/44 R; 118/309; 454/52

[58] Field of Search ..... 98/115.2, 115.3; 236/49.3, 44 R; 118/309

[56] References Cited

U.S. PATENT DOCUMENTS

| | | | |
|---|---|---|---|
| 1,520,267 | 12/1924 | Waltz | 98/115.2 |
| 2,761,373 | 9/1956 | Owen | 98/115.2 |
| 4,127,106 | 11/1978 | Jensen | 126/299 D |
| 4,351,863 | 9/1982 | Roesner | 98/115.2 X |
| 4,687,686 | 8/1987 | Stofleth et al. | 98/115.2 X |

FOREIGN PATENT DOCUMENTS

| | | |
|---|---|---|
| 0253980 | 1/1988 | European Pat. Off. . |
| 519005 | 2/1931 | Fed. Rep. of Germany . |
| 2462942 | 2/1981 | France . |
| 2525926 | 4/1983 | France . |
| 630271 | 6/1982 | Switzerland . |

*Primary Examiner*—William E. Wayner

*Attorney, Agent, or Firm*—Reising, Ethington, Barnard, Perry & Milton

[57] ABSTRACT

A spray booth for applying a coating to a substrate includes an outer chamber (12) containing a fluid therein having a predetermined first temperature and/or humidity and an inner chamber (14) in fluid communication with the outer chamber (12). The inner chamber (14) contains the fluid therein at a higher predetermined second humidity and/or temperature. The inner chamber (14) includes a fan (42) for recirculating a flow of the fluid at the second predetermined temperature and/or humidity therethrough and filters (34,36,44,46) for removing airborne comtaminants. A temperature and/or humidity control device (58) exhausts a predetermined amount of the fluid from the inner chamber (14) out of the inner (14) and outer chambers (12) said exhausted fluid being essentially free of toxic contaminants, the exhaust of the fluid drawing fluid from the outer chamber (22) into the inner chamber (14) to lower the temperature and/or humidity in the inner chamber (14).

6 Claims, 1 Drawing Sheet

SPRAY BOOTH FOR APPLYING COATINGS TO A SUBSTRATE AND CONTROL DEVICE THEREFORE

TECHNICAL FIELD

The present invention relates to a booth for containing a substrate which is to be coated. More particularly, the present invention relates to a spray booth for applying a coating to a substrate wherein the temperature and/or humidity within the spray booth must be controlled to insure desired coating quality.

BACKGROUND ART

Various types of substrates are coated with various types of coatings wherein the environment surrounding the substrate must be controlled to insure the quality of the coating. For example, automotive parts, aerospace parts, and appliance parts have various types of coatings applied thereto. The coatings, such as paints, top coats, and aqueous metallic slurries are applied to these parts.

For example, the U.S. Pat. No. 3,248,251 to Allen invention, discloses metal filled aqueous chromate/-phosphate slurries. These slurries are commonly used on aerospace parts to impart a desired quality finish to the surface of the part. The quality of the finish is directly related to the environment about the part being coated.

The quality of any finish of an applied paint or other coating depends upon the cleanliness of the environment in which it is applied. With regard to waterborne materials, such as that described in the above mentioned Allen patent, moisture content of the environment can exert an even greater influence upon the coating. Therefore, it is critical to control the humidity of the environment in which the coating is being applied.

There are additional environmental concerns with regard to the application of various coatings. For example, chromate/phosphate slurries and aluminum filled chromate/phosphate coatings are widely used in aerospace applications. The chemical stability of the slurry composition and corrosion the resistance of the binder system of these coatings are a consequence of the presence of hexavalent chromium in the material. Hexavalent chromium is environmentally toxic and its levels must be controlled during application. This control is particularly critical when the coating films are deposited on parts by air spray techniques.

It is therefore desirable to provide a spray booth for applying coatings such as those discussed above wherein the spray booth controls the moisture content of the environment around the part being coated. It is further desirable for the spray booth to control the velocity flow of air therein. Controlling these environmental conditions facilitate reproducible deposition of uniform, tightly adherent, smooth coatings.

Prior art spray booths include large devices which recirculate humidified air in a closed loop to achieve humidity control. These devices were expensive, inefficient and poorly designed. These devices also recirculate air past the operator resulting in problems with Federal air/workplace regulations. It is therefore desirable to not only control temperature and humidity, but also comply with Federal regulations which limit the discharge of toxic, volatile, or other hazardous materials.

The U.S. Pat. No. 4,521,227 to Gerdes et al, issued Jun. 4, 1985, provides an improved air washer or scrubber for paint spray booths accommodating different air flows. The patent does not disclose any means for controlling the humidity within the paint spray booth.

The U.S. Pat. No. 4,590,847 to Hull, issued May 27, 1986, discloses an energy conservation upgrading for existing exhaust booths which provides an attachable air curtain supply make-up apparatus which delivers a substantial independent supply of outside air into an exhaust booth enclosure about the periphery of its inlet opening. This patent discloses no means for controlling the humidity within a spray booth.

The U.S. Pat. No. 4,616,594 to Itho, issued Oct. 14, 1986, discloses a painting booth including means for controlling temperature and humidity. Air having an appropriately controlled temperature and humidity is supplied into a zone in a painting chamber through which the object to painted is conveyed. This air supply is provided from ambient air passing through a humidity and temperature control apparatus directly over the substrate to be painted while air from a second source flows outside the first stream of air having the controlled temperature and humidity. The Itho patent does not disclose a totally controlled isolated environment within a second controlled environment wherein the second controlled environment is utilized to regulate the temperature and humidity of the contained controlled environment.

The present invention provides a controlled environment which maintains constant moisture content in the spray booth while also controlling velocity and flow of air in the environment immediately surrounding the part being coated, thus facilitating the reproducible deposition of the coatings. The device further limits the discharge of hazardous materials outside of the spray facility. Further, the present invention can be adapted for various coating processes.

SUMMARY OF THE INVENTION

In accordance with the present invention, there is provided a spray booth for applying a coating to a substrate, the spray booth including an outer chamber containing a fluid therein having a predetermined first temperature and/or humidity and an inner chamber in fluid communication with the outer chamber. The inner chamber contains the fluid therein at a higher predetermined second humidity and/or temperature. The inner chamber includes recirculation means for recirculating a flow of the fluid at the second predetermined temperature and/or humidity therethrough. The inner chamber contains filters for removing airborne contaminants. Temperature and/or humidity control means exhaust a predetermined amount of the fluid from the inner chamber outside the outer chamber, the exhaust of the fluid drawing fluid from the outer chamber into the inner chamber to lower the temperature and/or humidity in the inner chamber.

FIGURES IN THE DRAWINGS

Other advantages of the present invention will be readily appreciated as the same becomes better understood by reference to the following detailed description when considered in connection with the accompanying drawings wherein:

FIG. 1 shows a schematic cross sectional view of a spray booth constructed in accordance with the present invention.

DETAILED DESCRIPTION OF THE INVENTION

Figure 1:
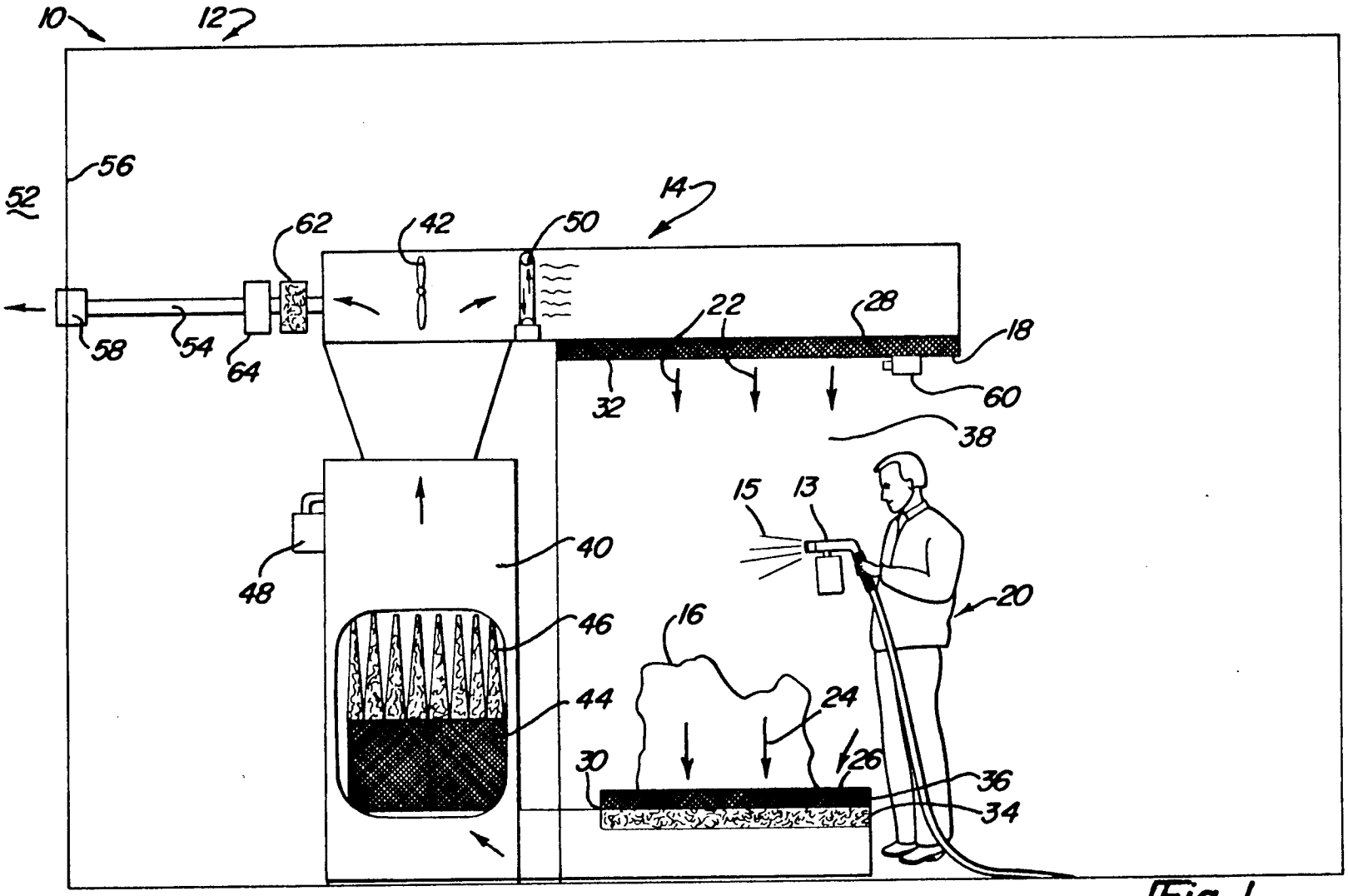

A spray booth for applying a coating to a substrate is generally indicated at 10 in the Figure. The Figure shows a hand-held spray gun 13 spraying a coating 15 on a substrate 16 schematically shown.

Generally, the spray booth 10 includes an outer chamber generally indicated at 12 and an inner chamber generally indicated at 14. The outer chamber 12 contains a fluid therein, such as air, having a predetermined first temperature and/or humidity. The outer chamber 12 contains a much larger space than does the inner chamber 14. The space within the outer chamber 12 is environmentally controlled. The volume of the air in the outer chamber 12 is larger than (preferably at least twice) the volume of the inner chamber 14. However, the size of the outer chamber can be much larger. Air born contaminants within the outer chamber 12 are controlled, preferably at least to a level of a class 200,000 clean room as described in Federal Standard 209. The humidity of the larger space is maintained at a humidity of between 25% and 45%. Preferably, the humidity within the outer chamber 12 is maintained between 30% and 40%. The temperature in the outer chamber 12 can be maintained at between 62° and 80° F. Preferably, the temperature in the outer chamber 12 is maintained between 68° and 72° F. It must be noted that these humidities and temperatures are preferred for the application of a chromate/phosphate slurry as disclosed in the Allen patent discussed above. However, the present invention can function utilizing other types of coatings which will require different humidity and temperature ranges.

For example, the present invention can be adapted for the application of waterborne paints (including some solvents), solvent based coatings, and thermalspraying in which materials such as metals and ceramics are thermally processed into coating films.

The inner chamber 14 is in fluid communication with the outer chamber 12 through a front opening 18 in the inner chamber 14. In other words, the inner chamber (14) includes three walls, a top and a bottom and is open to the outer chamber 12 through opening 18. In the figure, the person 20 schematically shown spraying the substrate 16 with coating 15 is positioned within the opening 18.

The fluid contained within the inner chamber 14 is the same fluid, such as air, contained within the outer chamber 12. The fluid within the inner chamber 14 is maintained at a higher predetermined second humidity and/or temperature than the fluid in the surrounding outer chamber 12. Preferably, humidities greater than 35% are maintained in the environment immediately surrounding the substrate 16 being coated.

The inner chamber 14 includes a recirculation system for recirculating a flow of the fluid at the second predetermined temperature and/or humidity therethrough. This air flow is from above the substrate 16, as shown by arrows 22 to below the substrate, as shown by arrows 24. This is commonly referred to as a downdraft flow.

There is an equilibrium maintained between the fluid in the outer chamber 12 and inner chamber 14 in the form of a gradient of humidity and/or temperature. Under normal operating conditions, the fluid from the outer chamber 12 does not substantially mix with the fluid in the inner chamber 14 because the fluid in the inner chamber 14 is recirculated and substantially constant volume of the fluid is maintained.

More specifically, the substrate 16 is supported on a substrate platform 26. The opening 18 allows access from the outer chamber 12 to the substrate platform 26 as well as allowing fluid communication between the inner chamber 14 and outer chamber 12. The inner chamber 14 includes a recirculation inlet 28 and a recirculation outlet 30. A filter 32 is disposed over the inlet 28 and filters 34 is disposed over outlet 30. A prefilter 36 may be disposed over the filter 34. Filters 36 and 34 located below the substrate 16 remove overspray from the airflow. These filters 34,36 further remove air borne particulates. Such filters function in layers and can be composed of many different materials. Obviously the filter media must be unattacked by the atomized particles being sprayed. Examples of such filters are Such filters may be metallic, such as stainless steel mesh or wool or they may be paper such as are commonly used in spray booths. Paper or similar materials are not recommended for the device described herein because used filters become waste and probably hazardous waste because of the heavy metals that they trap. It is desirable to use filter media that is reusable and highly efficient. For example, filter 36 which is exposed to the coalescing stream of overspray is the most porous and open filter in the syste. A washable fiberglass filter mat is most suitable in this case. Obviously other washable open weave filters can be used.

Filter 34 may be denser in its construction and can be fiberglass, nonwoven polyethylene or other polyolefin. These filters are all inert and washable. Other types may be used.

The filter 32 located at inlet 28 filters the down draft flow of air over the substrate 16. This filter assures a uniform downward wash of laminar air flowing across the substrate 16. The filters 32,34,36 may be washable filters.

The space 38 within the inner chamber 14 between filters 32 and 36 defines a coating chamber in which the substrate 16 is coated. It is within this coating chamber 38 that it is critical to control the temperature and/or humidity to thereby perfect the quality of the coating over the substrate 16.

A fluid flow column 40 is in fluid communication between the fluid outlet 30 and fluid inlet 28. A fan device 42 is disposed above the column 40 for creating the flow of the fluid into and out of the third chamber 38. Generally, a variable speed fan 42 is utilized to recirculate the air. The disposable overspray filter removes 99% of the overspray. Optimally, the filter would be replaced daily. The column 40 further includes various types of filters for filtering toxic and hazardous contaminents from the fluid flowing therethrough. As shown in the Figure, the column 40 may include carbon cells 44 and bag filters 46. The activated charcoal cells 44 may be added to the column 40 for removing organic solvents from the stream of fluid flow. The bag filters 46 are used to remove airborne particulates from the air flow and is used to "polish" the air by removing the last remaining contaminant particles. An air sampler 48 can be added to the system for constantly sampling the air passing through the filters 44,46 to detect the presence of toxins in the air stream. If the levels of toxins exceed operating standards, the system will automatically shut down until the filters are changed.

The system can further include a humidifier 50 for increasing the humidity of the air flow through the coating chamber 38 if it drops below a predetermined level.

The invention is characterized by including temperature and/or humidity controls for exhausting a predetermined amount of the fluid from the inner chamber 14 out of the both the inner and outer chambers 12,14, the exhaust of the fluid drawing fluid from the outer chamber 12 into the inner chamber to lower the temperature and/or humidity of the inner chamber. That is, as previously described, an equilibrium exists between the fluid flow in the inner chamber 14 and the fluid in the outer chamber 12. The outer chamber 12 includes fluid, such as air, having a relative humidity and/or temperature kept at a lower level than that used for spraying. The inner chamber 14 has a higher humidity, typically 40% to 55%, depending on the coating being applied. When an aqueous coating is being sprayed it also adds to increasing the humidity within the inner chamber 14. Humidity may also be introduced into the chamber by the humidifier 50. Humidity and/or temperature is decreased in the inner chamber 14 by exhausting fluid from the inner chamber 14 in accordance with the present invention and thereby drawing the lower humidity and/or temperature air from the outer chamber 12 into the downdraft loop fluid flow within the inner chamber 14. Since the fluid in the inner 14 and outer 12 chambers are in equilibrium, the removal or exhaust of part of the volume of fluid from the inner chamber 14 draws fluid from the outer chamber 12 into the inner chamber 14 to replace the lost fluid and reestablish the equilibrium. The fluid drawn in from the outer chamber 12 lower the temperature and/or humidity of the fluid in the inner chamber 14. Thusly, the humidity and/or temperature of the fluid in the inner chamber 14 can be adjusted.

To assure that contaminants do not accumulate within the closed loop of the inner chamber 14 an on-stream counter (48) samples particulate content in the fluid circulating within the inner chamber 14 after that fluid passes through filters 34,36,46 and (optionally) 44. Should the particulate content of this fluid exceed prescribed threshold limits (predetermined according to air quality standards for the contaminants anticipated in the process, the counter 48 will disable the fan 42 until filters 34,36,46 and/or 44 are cleaned or changed. Examples of such on-stream counters are manufactured by Climet, Inc., Redlands, Calif. 92373.

More specifically, the control device made in accordance with the present invention is in fluid communication between the fluid flow column 40 and an environment 52 outside of the outer chamber 12. This is accomplished by the control device including a conduit 54 extending between the column 40 and one of the sidewalls 56 of the outer chamber 12. An exhaust fan 58 is disposed within the conduit 54 for drawing fluid from the column 40 through the conduit 54 to the environment 52 outside of the outer chamber 12. A humidity and/or temperature sensor 60 is disposed in the chamber 38 and is operatively connected to the exhaust fan 58 for actuating the operation of the exhaust fan 58 when the sensor 60 senses a rise in temperature and/or humidity above a predetermined desired level for optimum coating conditions. A filter 62 and air sampler 64 can be located on the conduit 54 for sampling the particulate content of the fluid being exhausted through conduit 54. Again, if toxins are detected by the air sampler 64 above predetermined levels, the system would be actuated to shut down. For example, such an air sampler monitor can determine chromium levels in the air after the air passes through the various filters in the system. When any chromium (+6) is detected, the filters in the system would be removed and washed or replaced. The air sampler can be a constant flow pump (as manufactured by SKC Inc., Eighty Four, Penna. 15330, using a 5 m PVC filter per the NIOSH procedure.

In operation, the outer chamber 12 may be an air conditioned room or environmental enclosure having a temperature preferably between 68° and 72° F. and a relative humidity of between 30% and 40%. This room may include a single inner chamber 14 or several inner chambers. The fan 42 would circulate air in a downdraft fashion through the chamber 38 from top to bottom. An operator 20 using a hand held spray gun 13 would spray coating 15 onto a substrate 16.

The air continually flows through the inner chamber and is filtered by the various filters and carbon cells disclosed above. If the humidity and/or temperature within the chamber 38 rises above a predetermined level, a fraction of the clean filtered air within the column 40 is vented to the atmosphere 52 outside of the outer chamber 12, which is an environmentally controlled enclosure. This exhausted air (having toxins removed therefrom) is replaced by the lower relative humidity air from within the outer chamber 12. In this way, locally high humidities may be maintained without delivering large amounts of moisture in large volumes of air.

The present invention can be used in conjunction with any air or airless spray application technique. However, it has been determined that high volume low pressure spray methods, known as HVLP, are preferred for the present invention.

It has been found that such spray guns 13 maximize transfer efficiency and reduce air flow requirements in coating operations, such as those used for applying the coating disclosed in the '251 patent discussed above.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A spray booth (10) for applying a coating to a substrate, said booth (10) comprising: an outer chamber (12) containing a fluid therein having a predetermined first temperature and/or humidity; an inner chamber (14) in fluid communication with said outer chamber (12) and containing said fluid therein at a different predetermined second humidity and/or temperature, said inner chamber (14) including recirculation, means for recirculating a flow of the fluid at said predetermined temperature and/or humidity therethrough; and temperature and/or humidity control means for exhausting a predetermined amount of the fluid from said inner chamber (14) out of said inner and outer chamber (12,14), said exhaust of the fluid drawing fluid from said outer chamber (12) into said inner chamber (14) to change the temperature and/or humidity in said inner chamber (14), said inner chamber (14) including a substrate platform for supporting a substrate to be coated thereon and an opening (18) to said outer chamber (12) allowing access from said outer chamber (12) to said substrate platform (26), said opening allowing fluid communication between said inner (14) and outer (12) chambers, said inner chamber (14) further including a recirculation inlet (28) and outlet (30), said recirculation means including a fluid flow column (40) in fluid communication between said recirculation inlet (28) and outlet (30), said column (40) including fan means (42) for creating the flow of the fluid into and out of said third chamber (38) and filter means for filtering the fluid flowing therethrough, said exhaust means being fluid communication between said fluid flow column (40) and an environment (52) outside of said outer chamber (12).

2. A booth as set forth in claim 1 wherein said filter means is disposed within said column (40) between said recirculator outlet (30) and said exhaust means.

3. A booth as set forth in claim 2 wherein said outer chamber (12) includes four side walls, said exhaust means including a conduit (54) extending between said column (40) and one of said side walls (56), said fan means (58) being disposed within said conduit for drawing fluid from said column (40) and through said conduit (54) to the environment (52) outside of said outer chamber (12).

4. A booth as set forth in claim 3 including humidifier means (50) disposed within said column (40) for humidifying the fluid.

5. A booth as set forth in claim 1 including humidity and/or temperature sensor means (60) disposed in said inner chamber (14) and operatively connected to said temperature and/or humidity control means for actuating operation of said control means when said sensor means (60) senses a rise in temperature and/or humidity above a third predetermined level.

6. A method of controlling the temperature and/or humidity within a paint spray booth (14) having an inner chamber (38) which recirculates fluid therethrough, the booth (14) being disposed with an outer chamber (12) having a predetermined temperature and/or humidity within a predetermined desirable range and being in fluid communication with the inner chamber (38), said method including the steps of: sensing the temperature and/or humidity of the inner chamber (38), actuating the exhaust of fluid from the inner chamber (38) at a predetermined temperature and/or humidity of the fluid within the inner chamber (38), the exhaust drawing into the inner chamber (38) the fluid from the outer chamber (12) thereby changing the temperature within the inner chamber (38) to with a predetermined desirable range of temperature and humidity, exhausting the fluid from the inner chamber (38) out of the inner chamber (38) and outer chamber (12) and drawing the fluid from the outer chamber (12) into the inner chamber to adjust the temperature and/or humidity of the inner chamber (38) to the desirable range.

* * * * *